US011161656B2

(12) United States Patent
Wang

(10) Patent No.: US 11,161,656 B2
(45) Date of Patent: Nov. 2, 2021

(54) CHILD PROTECTIVE PACKAGING CONTAINER AND ITS METHOD OF USE

(71) Applicant: Shenzhen Shikai Technology Co., Ltd., Shenzhen (CN)

(72) Inventor: Shenyi Wang, Shenzhen (CN)

(73) Assignee: Shenzhen Shikai Technology Co., Ltd., Shenzhen (CN)

( * ) Notice: Subject to any disclaimer, the term of this patent is extended or adjusted under 35 U.S.C. 154(b) by 216 days.

(21) Appl. No.: 16/520,208

(22) Filed: Jul. 23, 2019

(65) Prior Publication Data

US 2020/0148437 A1 May 14, 2020

(30) Foreign Application Priority Data

Nov. 9, 2018 (CN) ..... 201811328709.9
Nov. 9, 2018 (CN) ..... 201821842232.1

(51) Int. Cl.
*B65D 50/04* (2006.01)
*B65D 51/24* (2006.01)

(52) U.S. Cl.
CPC ..... *B65D 50/046* (2013.01); *B65D 51/245* (2013.01)

(58) Field of Classification Search
CPC ..... B65D 50/046; B65D 51/245
USPC ..... 215/209, 211, 216; 220/324, 326
See application file for complete search history.

(56) References Cited

U.S. PATENT DOCUMENTS 1,847,117 A * 3/1932 Lantero ..... B60K 15/0406 70/172
3,181,718 A * 5/1965 Chancellor ..... B65D 50/046 215/213
3,599,821 A * 8/1971 Eggert ..... B65D 50/045 215/301
3,735,887 A * 5/1973 Morris ..... B65D 50/046 215/221
3,863,798 A * 2/1975 Kurihara ..... B65D 41/185 215/301
4,586,623 A * 5/1986 Hatakeyama ..... B65D 41/02 215/301
4,676,393 A * 6/1987 Daniel ..... B60K 15/0406 220/281
4,830,058 A * 5/1989 Harris ..... B60K 15/0406 138/89
4,872,584 A * 10/1989 Sakai ..... F01P 11/0247 220/201
5,381,919 A * 1/1995 Griffin ..... B60K 15/0406 220/326
5,405,038 A * 4/1995 Chuang ..... B65B 31/047 137/522
9,926,114 B2 * 3/2018 Eberlein ..... B65D 45/16
(Continued)

*Primary Examiner* — James N Smalley
(74) *Attorney, Agent, or Firm* — Novoclaims Patent Services LLC; Mei Lin Wong

(57) ABSTRACT

A child protective packaging container and a method of use thereof which includes a main body defining a cavity for receiving an article, a bottom portion indented downwardly and an opening portion protruded upwardly; a cap having a raised portion corresponding to a shape and a size of the opening portion; and a safety button hidden and received inside a receiving cavity of the raised portion of the cap for restricting the opening and closing of the cap with respect to the main body. The present invention has the advantages of good safety performance, and high cost effectiveness.

10 Claims, 9 Drawing Sheets

(56) References Cited

U.S. PATENT DOCUMENTS

2007/0241107 A1* 10/2007 Matsumoto ..... B65D 39/12
220/238
2012/0175336 A1* 7/2012 Miller ..... B65D 3/18
215/216

* cited by examiner

CHILD PROTECTIVE PACKAGING CONTAINER AND ITS METHOD OF USE

BACKGROUND OF THE PRESENT INVENTION

Field of Invention

The present invention relates to packaging technology, and more particularly to a child protective packaging container and its method of use.

Description of Related Arts

In daily life, we often hear news about fatal or serious injuries caused by children's eating unwanted edible object by mistake. We may feel this is an unfortunate event and we also can't help thinking the reason of happening. Some incidences are caused by the negligence of adults. On the other hand, it is not hard to think that manufacturers have some defects in the design of packaging products. In our daily lives, we will use a lot of different packaging parts, such as container bottles. The cap and bottle body of existing packaging are too simple to connect, which is very easy to open during operation. When children are playing with the bottle, it is easy to open the cap and expose the contents of the bottles, thus causing a safety hazard for children to eat by mistake. At present, there are some packages designed for children, such as bottles with safety caps. However, these products generally have the following disadvantages: 1. The protection is not good. Children can open the protective lock after repeated operations, which is easy to cause safety hazards. 2. Although it can prevent children from opening, it is also difficult for adult to open, resulting in inconvenience in use. 3. The safety protection function of the cap needs to be completed in combination with the bottle main body, so the manufacturers need to refit the bottle body to match the safety cap for use, resulting in increased production costs, thus also hindering the promotion of use of safety products.

SUMMARY OF THE PRESENT INVENTION

An object of the present invention is to provide a child protective package which has high level of safety for child protection, high level of convenience in use by adult, and low modification cost.

In order to solve the above technical problems, the present invention employs the following technical solutions:

A child protective packaging container, which comprises a main body defining a main cavity therein for containing an article and having a bottom portion indented downwardly and an opening portion protruded upwardly;

a cap having a raised portion corresponding to a shape and a size of the opening portion and a receiving cavity inside the raised portion; and a safety button hidden by and received inside the receiving cavity of the raised portion of the cap for controlling an opening or a closing of the cap with respect to the main body.

A spring arrangement is disposed inside the safety button.

The spring arrangement is a spring.

At least one sliding lock member is elastically connected to the safety button at a bottom side of the safety button.

Preferably, the cap has a base, two sliding lock members are provided and connected to the base at two opposite sides of the base of the cap, and the two sliding lock members are connected by a locking spring.

Preferably, there are two sliding lock members elastically connected to the safety button at a bottom side of the safety button; a based disposed at the cap and connected to the two sliding lock members at two opposite sides of the base of the cap; and a locking spring connecting the two sliding lock at two opposite ends.

A pair of matching thread members are disposed at an inner wall of the cap and an outer wall of the opening portion respectively.

The cap and the safety button are positioned at the same level in a stationary state.

An on/off operation label is provided at the cap or the main body.

A method of use of the child protective packaging container by using the child protective packaging container as disclosed above.

After putting objects inside the cavity of the bottle main body, the bottle cap is screwed into the bottle opening portion. Gently press the bottle cap downwardly with an external force such that when the sliding lock members pass through the bottle opening portion, the sliding lock members is compressed and contracted by the inner wall of the bottle main body. At the same time, the bottle cap is rotated in an opposite direction of the spiral thread of the thread member so that the thread member at the inner wall of the bottle cap and the thread member at the outer wall of the bottle opening portion are screwed together tightly. After the sliding lock members enter inside the bottle main body through the bottle opening portion, the external force is stopped, the sliding lock members are in an expanded state and lock between the inside of the bottle main body and the bottle opening portion, thus the bottle cap and the bottle main body are locked together from the inside.

A method of use of the child protective packaging container by using the child protective packaging container as disclosed above, comprising the steps of:

(a) cap closing operation by screwing the cap into the opening portion, pressing the cap gently and downwardly with an external force such that when the sliding lock member passes through the opening portion, the sliding lock member is compressed and contracted by an inner wall of the main body and simultaneously rotating the cap in a forward direction of the spiral thread of the thread member so that the thread member at the inner wall of the cap and the thread member at the outer wall of the opening portion are screwed together tightly, then stopping to apply the external force after the sliding lock member is entered to an inner side the main body through the opening portion so that the sliding lock member is in an expanded state and lock between the inner side of the main body and the opening portion, thus locking the cap and the main body at the inner side of the main body;

(b) cap opening operation by pressing the safety button with an external force so that the sliding lock member is contracted under the action of the external force and then the cap is unlocked from the inner side of the main body; and simultaneously rotating the cap in an opposite direction of the spiral thread of the thread member so that the sliding lock member is rotated to reach the opening portion and is compressed to contract by the inner wall of the opening portion; then releasing the safety button from pressing so that the safety button is spring back to a normal position; and rotating the cap continuously until the cap is unscrewed from the opening portion.

Accordingly, the present invention has the following advantageous effect:

1. The present invention hides the necessary safety button for opening the cap in the cap, which requires special attention to discover the position of the safety cap. Without pressing the safety button, whether the bottle cap is rotated to the left or to the right, or is moderately pulled, the cap cannot be opened. In view of the limited observation ability of children, it is difficult for children to find out the protective feature of the cap, so that the protective cap is not easily opened by children.

2. The cap closing operation of the present invention is regular and convenient, and the cap opening operation is relatively complicated. Because the limited dexterity of children or their inability to finely coordinated, on the one hand, the child is not easy to imitate the opening operation, on the other hand, the child is not strong enough, therefore the child is unable to open the bottle cap with sufficiently great force. For adults, the operation method is shown on the outside of the packaging container, it is easy to understand and easy to operate after mastering the use skills.

3. The cap and the main body of the present invention are provided with threads. Even if the bottle cap is pressed, the bottle cap cannot be opened if the rotation direction is not correct, thereby achieving multiple protection measures for the bottle.

4. The protective structure of the present invention is embodied at the cap. Therefore, the cap which is suitable for the body can be made according to the structure of the body. The protection function can be realized by using the main body of the conventional structure and the main body is not required to be modified. Therefore, the production cost can be reduced, the product is more marketable and is easy to promote.

Accordingly, compared to conventional arts, the present invention has significant improvement.

The features and advantages of the present invention will become more apparent from the detailed description of the embodiments.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
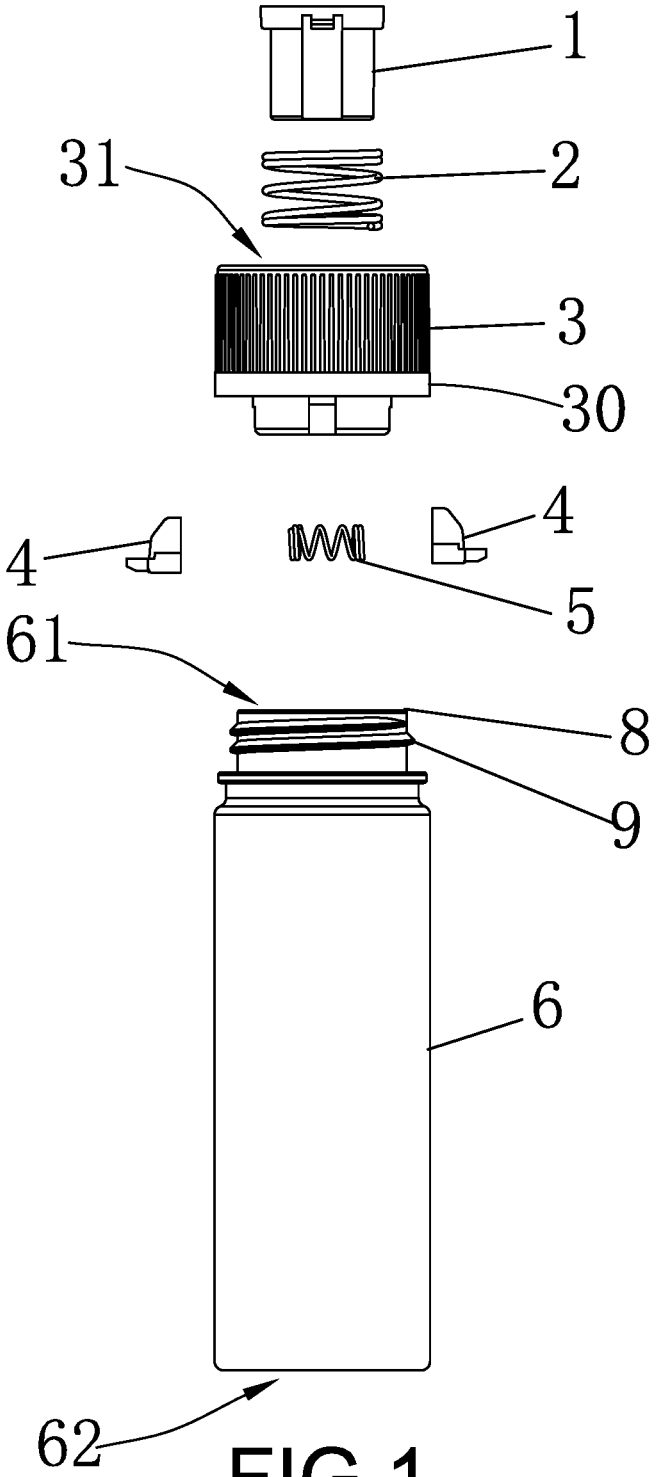
FIG. 1 is a schematic view according to a preferred embodiment of the present invention.
Figure 2:
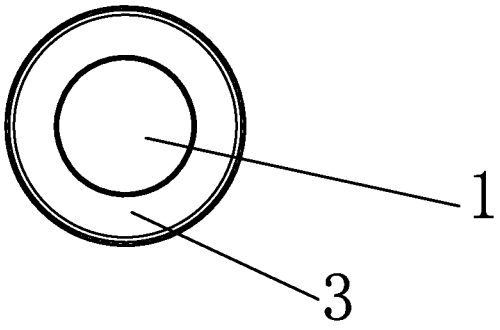
FIG. 2 is a top view according to the above preferred embodiment of the present invention.
Figure 3:
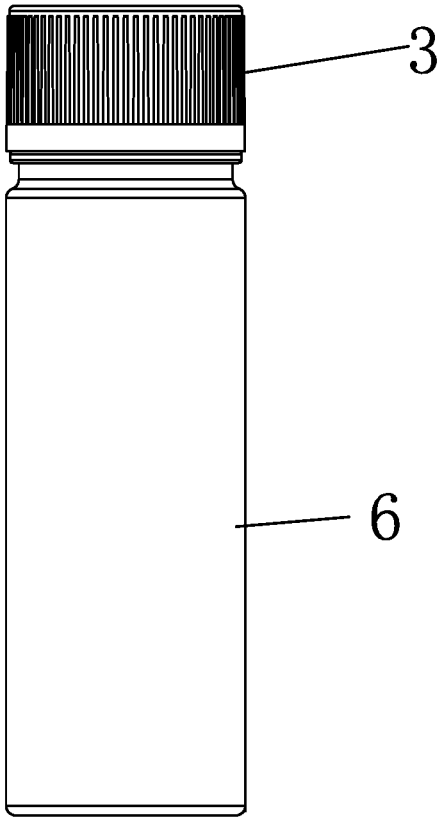
FIG. 3 is a schematic view showing the overall appearance according to the above preferred embodiment of the present invention.
Figure 4:
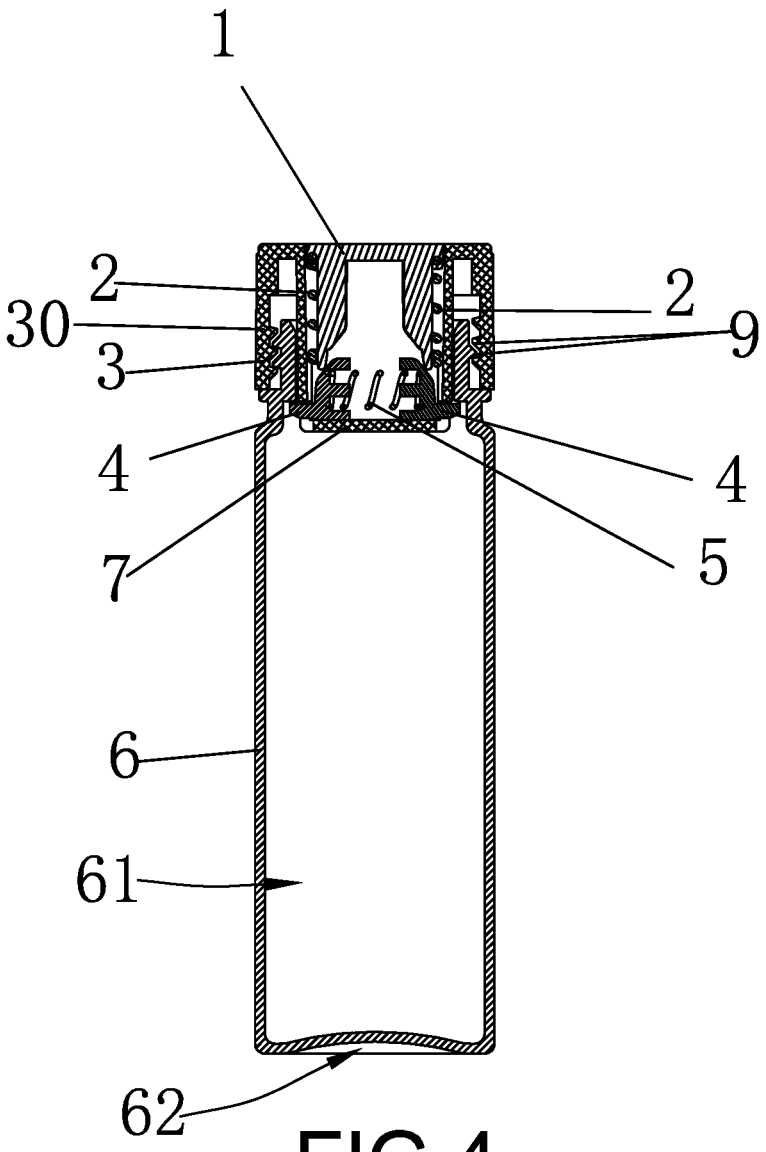
FIG. 4 is a schematic sectional view according to the above preferred embodiment of the present invention.
Figure 5:
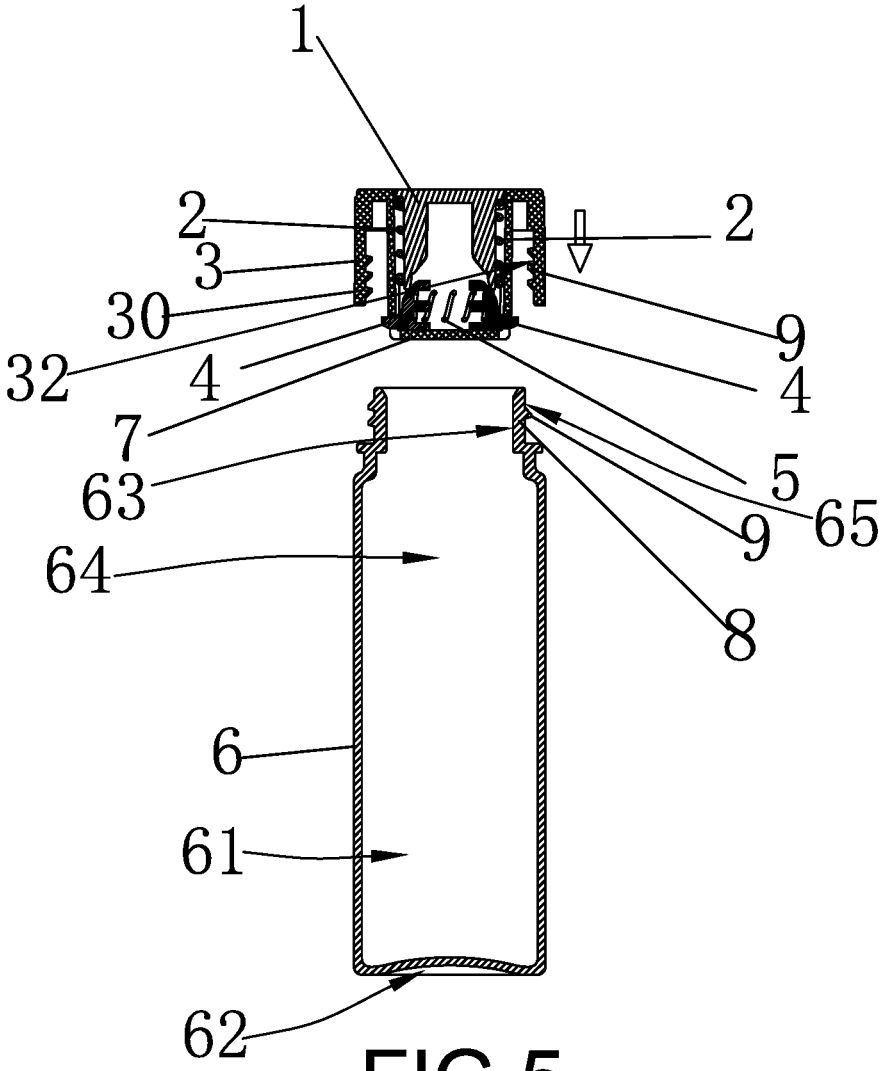
FIG. 5 is a first schematic view showing a cap closing operation according to the above preferred embodiment of the present invention.
Figure 6:
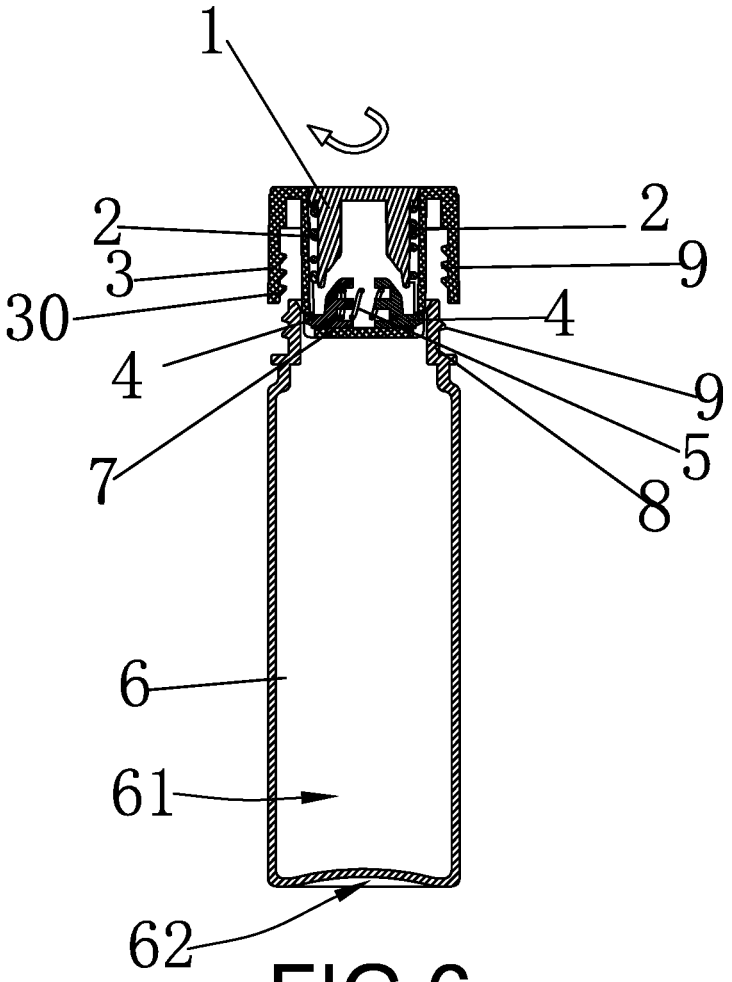
FIG. 6 is a second schematic view showing a cap closing operation according to the above preferred embodiment of the present invention.
Figure 7:
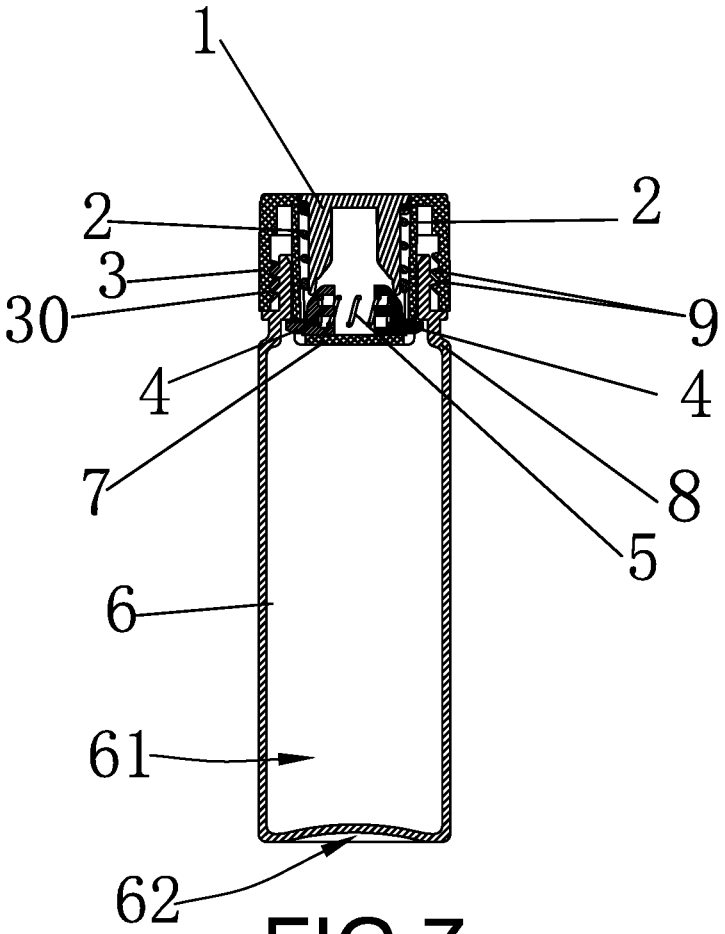
FIG. 7 is a third schematic view showing a cap closing operation according to the above preferred embodiment of the present invention.

The present invention will be further described in detail below with reference to its preferred embodiments.

Referring to FIG. 1 to FIG. 4 of the drawings, a child protective packaging container according to a preferred embodiment of the present invention is illustrated. According to this embodiment, the child protective packaging container is a packaging bottle which includes a bottle main body 6 defining a bottle main cavity therein for containing an article and having a bottom portion 62 indented downwardly and a bottle opening portion 8 protruded upwardly; a bottle cap 3 having a raised portion 30 corresponding to a shape and a size of the bottle opening portion 8 and a receiving cavity 31 inside the raised portion 30; a safety button 1 hidden and received inside the receiving cavity 31 of the raised portion 30 of the bottle cap 3 in such a manner that the safety button 1 and the bottle cap 3 are at the same level in a stationary state; a button spring 2 is disposed in the safety button 1; two sliding lock members 4 elastically connected to the safety button 1 at a bottom side of the safety button 1; a base 7 connected to the two sliding lock members 4 at two opposing sides respectively; a locking spring 5 connecting between the two sliding lock members 4; and a pair of matching thread members 9 are disposed at an inner wall 32 of the bottle cap 3 and an outer wall of the bottle opening portion 8 respectively. When pressing the safety button 1, under the action of the button spring 2, the safety button 1 and the sliding lock members 4 are connected while the pressure is transmitted to the sliding lock members 4. Under application of sufficient pressure, the sliding lock members 4 can inwardly contracted by the locking spring 5, and can also outwardly extended when the pressure is removed.

Preferably, in the specific implementation of the present invention, an operation label of open/close cover can be provided on the bottle cap 3 or the bottle main body 6, such as an arrow indicating the direction of rotation, and the like, which is convenient for adult operation.

Figure 8:
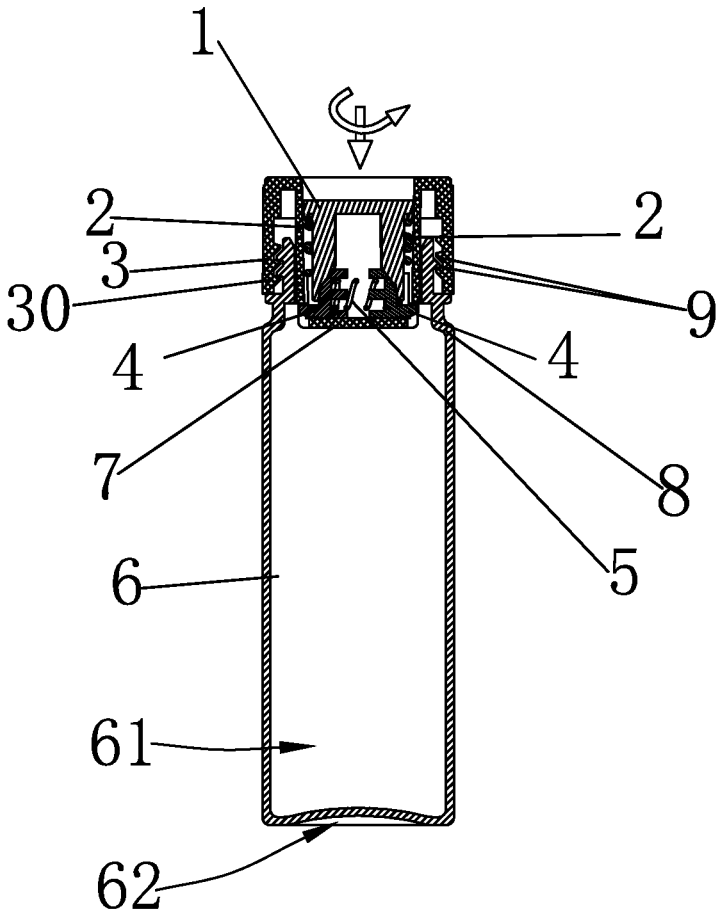
FIG. 8 is a first schematic view showing a cap opening operation according to the above preferred embodiment of the present invention.
Figure 9:
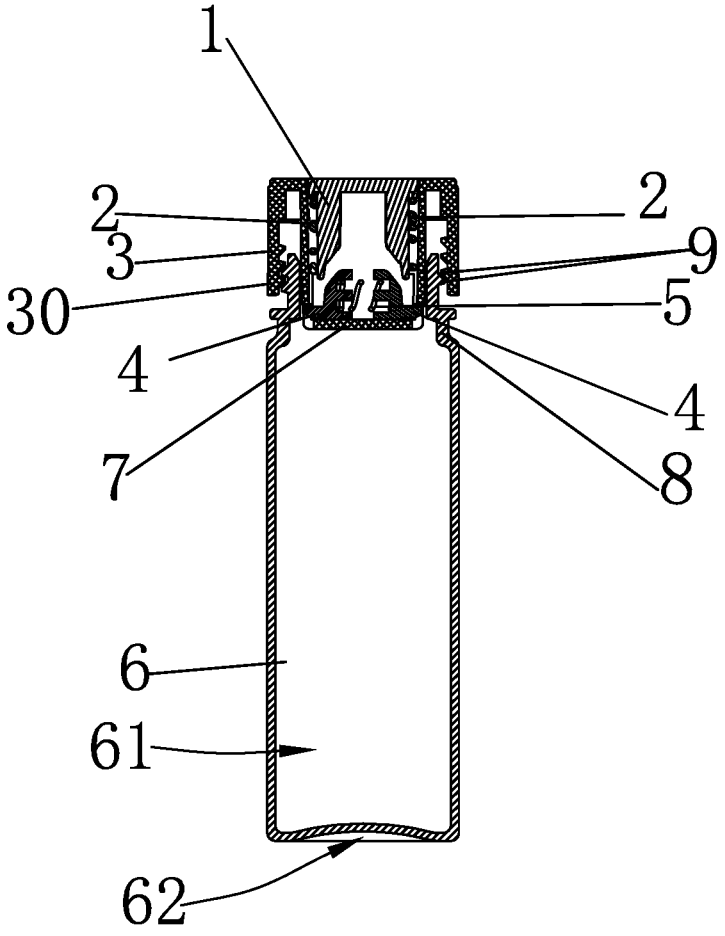
FIG. 9 is a second schematic view showing a cap opening operation according to the above preferred embodiment of the present invention.
Figure 10:
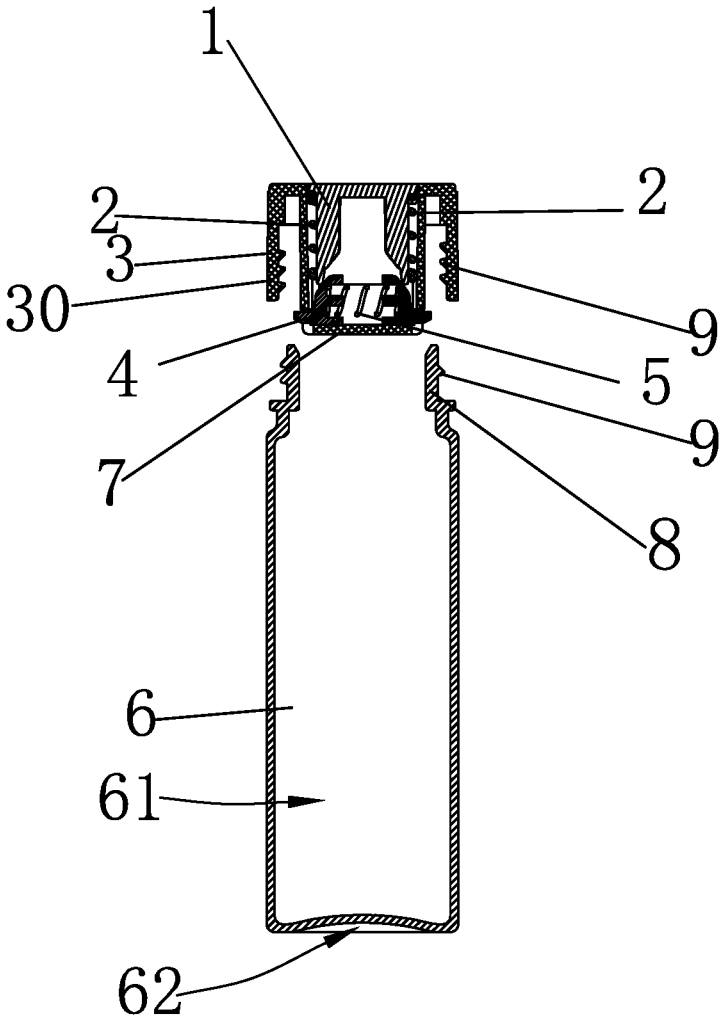
FIG. 10 is a third schematic view showing a cap opening operation according to the above preferred embodiment of the present invention.

Referring to FIGS. 8-10 of the drawings, the present invention further comprises a method of preventing a child from opening a packaging container. By using a child protective packaging container as disclosed above, after putting objects inside the cavity 61 of the bottle main body 6, the bottle cap 3 is screwed into the bottle opening portion 8. Gently press the bottle cap 3 downwardly with an external force such that when the sliding lock members 4 pass through the bottle opening portion 8, the sliding lock members 4 is compressed and contracted by the inner wall 63 of the bottle main body 6. At the same time, the bottle cap 3 is rotated in an opposite direction of the spiral thread of the thread member 9 so that the thread member at the inner wall 32 of the bottle cap and the thread member 9 at the outer wall 65 of the bottle opening portion 8 are screwed together tightly. After the sliding lock members 4 enter inside the bottle main body 6 through the bottle opening portion 8, the external force is stopped, the sliding lock members 4 are in an expanded state and lock between the inside of the bottle main body 6 and the bottle opening portion 8, thus the bottle cap 3 and the bottle main body 6 are locked together from the inside.

Referring to FIGS. 5-10 of the drawings, a method of use of a child protective packaging container according to a preferred embodiment of the present invention by using the child protective packaging container as disclosed above comprises the following steps of:

Cap Closing Operation:

Screwing the bottle cap 3 into the bottle opening portion 8, pressing the bottle cap 3 downwardly with an external force gently such that when the sliding lock members 4 pass through the bottle opening portion 8, the sliding lock members 4 are compressed and contracted by the inner wall 63 of the bottle main body 6 and simultaneously rotating the bottle cap 3 in a forward direction of the spiral thread of the thread member 9 (i.e. clockwise) so that the thread member 9 at the inner wall 32 of the bottle cap 3 and the thread member 9 at the outer wall 65 of the bottle opening portion 8 are screwed together tightly, stopping to apply the external force after the sliding lock members 4 enter inside the bottle main body 6 through the bottle opening portion 8 so that the sliding lock members 4 are in an expanded state and lock between the inside of the bottle main body 6 and the bottle opening portion 8, thus locking the bottle cap 3 and the bottle main body 6 together from the inside;

Cap Opening Operation:

Pressing the safety button 1 with a relatively strong external force so that the sliding lock members 4 are contracted under the action of the external force and then the bottle cap 3 is unlocked from the inner side 65 of the bottle main body 6; and simultaneously rotating the bottle cap 3 in the opposite direction of the spiral thread of the thread member 9 (i.e. anti-clockwise) so that the sliding lock members 4 are rotated to reach the bottle opening portion 8, and the sliding lock members 4 are compressed to contract by the inner wall 63 of the bottle opening portion 8; then releasing the safety button 1 from pressing so that the safety button 1 is spring back to its original position; and rotating the bottle cap 3 continuously until the bottle cap 3 is unscrew from the bottle opening portion 8.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A child protective packaging container, comprising:

a main body defining a main cavity therein for containing an article and having a bottom portion indented downwardly and an opening portion protruded upwardly, a cap having a raised portion corresponding to a shape and a size of the opening portion and a receiving cavity inside the raised portion;

a safety button hidden by and received inside the receiving cavity of the raised portion of the cap for controlling an opening or a closing of the cap with respect to the main body; and at least one sliding lock member connected to the safety button at a bottom side of the safety button.

2. The child protective packaging container according to claim 1, wherein the cap has a base, two sliding lock members are provided and connected to the base at two opposite sides of the base of the cap, and the two sliding lock members are connected by a locking spring.

3. The child protective packaging container according to claim 2, comprising a pair of matching thread members disposed at an inner wall of the cap and an outer wall of the opening portion respectively.

4. A method of use of the child protective packaging container according to claim 3, comprising the steps of:

(a) cap closing operation by screwing the cap into the opening portion, pressing the cap gently and downwardly with an external force such that when the sliding lock member passes through the opening portion, the sliding lock member is compressed and contracted by an inner wall of the main body and simultaneously rotating the cap in a forward direction of the spiral thread of the thread member so that the thread member at the inner wall of the cap and the thread member at the outer wall of the opening portion are screwed together tightly, then stopping to apply the external force after the sliding lock member is entered to an inner side the main body through the opening portion so that the sliding lock member is in an expanded state and lock between the inner side of the main body and the opening portion, thus locking the cap and the main body at the inner side of the main body;

(b) cap opening operation by pressing the safety button with an external force so that the sliding lock member is contracted under the action of the external force and then the cap is unlocked from the inner side of the main body; and simultaneously rotating the cap in an opposite direction of the spiral thread of the thread member so that the sliding lock member is rotated to reach the opening portion and is compressed to contract by the inner wall of the opening portion; then releasing the safety button from pressing so that the safety button is spring back to a normal position; and rotating the cap continuously until the cap is unscrewed from the opening portion.

5. A child protective packaging container, comprising:

a main body defining a main cavity therein for containing an article and having a bottom portion indented downwardly and an opening portion protruded upwardly;

a cap having a raised portion corresponding to a shape and a size of the opening portion and a receiving cavity inside the raised portion;

a safety button hidden by and received inside the receiving cavity of the raised portion of the cap for controlling an opening or a closing of the cap with respect to the main body;

a spring inside the safety button; and two sliding lock members connected to the safety button at a bottom side of the safety button; a based disposed at the cap and connected to the two sliding lock members at two opposite sides of the base of the cap; and a locking spring connecting the two sliding lock at two opposite ends.

6. The child protective packaging container according to claim 5, comprising a pair of matching thread members disposed at an inner wall of the cap and an outer wall of the opening portion respectively.

7. The child protective packaging container according to claim 6, wherein a top surface of the cap and a top surface of the safety button are flush with each other in a stationary state.

8. A method of use of the child protective packaging container according to claim 6, comprising the steps of:

(a) cap closing operation by screwing the cap into the opening portion, pressing the cap gently and downwardly with an external force such that when the sliding lock member passes through the opening portion, the sliding lock member is compressed and contracted by an inner wall of the main body and simultaneously rotating the cap in a forward direction of the spiral thread of the thread member so that the thread member at the inner wall of the cap and the thread member at the outer wall of the opening portion are screwed together tightly, then stopping to apply the external force after the sliding lock member is entered to an inner side the main body through the opening portion so that the sliding lock member is in an expanded state and lock between the inner side of the main body and the opening portion, thus locking the cap and the main body at the inner side of the main body;

(b) cap opening operation by pressing the safety button with an external force so that the sliding lock member is contracted under the action of the external force and then the cap is unlocked from the inner side of the main body; and simultaneously rotating the cap in an opposite direction of the spiral thread of the thread member so that the sliding lock member is rotated to reach the opening portion and is compressed to contract by the inner wall of the opening portion; then releasing the safety button from pressing so that the safety button is spring back to a normal position; and rotating the cap continuously until the cap is unscrewed from the opening portion.

9. A method of use of the child protective packaging container, which comprises a main body defining a main cavity therein for containing an article and having a bottom portion indented downwardly and an opening portion protruded upwardly; a cap having a raised portion corresponding to a shape and a size of the opening portion and a receiving cavity inside the raised portion, and a safety button hidden by and received inside the receiving cavity of the raised portion of the cap for controlling an opening or a closing of the cap with respect to the main body, comprising the steps of:

(a) cap closing operation by screwing the cap into the opening portion, pressing the cap gently and downwardly with an external force such that when the sliding lock member passes through the opening portion, the sliding lock member is compressed and contracted by an inner wall of the main body and simultaneously rotating the cap in a forward direction of the spiral thread of the thread member so that the thread member at the inner wall of the cap and the thread member at the outer wall of the opening portion are screwed together tightly, then stopping to apply the external force after the sliding lock member is entered to an inner side the main body through the opening portion so that the sliding lock member is in an expanded state and lock between the inner side of the main body and the opening portion, thus locking the cap and the main body at the inner side of the main body;

(b) cap opening operation by pressing the safety button with an external force so that the sliding lock member is contracted under the action of the external force and then the cap is unlocked from the inner side of the main body; and simultaneously rotating the cap in an opposite direction of the spiral thread of the thread member so that the sliding lock member is rotated to reach the opening portion and is compressed to contract by the inner wall of the opening portion; then releasing the safety button from pressing so that the safety button is spring back to a normal position; and rotating the cap continuously until the cap is unscrewed from the opening portion.

10. The method of use of the child protective packaging container according to claim 9, wherein a pair of matching thread members are disposed at an inner wall of the cap and an outer wall of the opening portion respectively.

* * * * *